United States Patent [19]

Tanaka et al.

[11] 4,171,054

[45] Oct. 16, 1979

[54] WORK VEHICLE WITH HYDRAULIC CIRCUIT FOR SWIVEL MOTOR AND WORK ASSEMBLY ARM MOTOR

[75] Inventors: Ryoichi Tanaka, Neyagawa; Tadao Adachi, Sakai, both of Japan

[73] Assignee: Kubota, Ltd., Osaka, Japan

[21] Appl. No.: 863,296

[22] Filed: Dec. 22, 1977

[30] Foreign Application Priority Data

| | | | |
|---|---|---|---|
| Dec. 28, 1976 | [JP] | Japan | 51-158099 |
| Sep. 30, 1977 | [JP] | Japan | 52-132325[U] |
| Oct. 7, 1977 | [JP] | Japan | 52-135315[U] |

[51] Int. Cl.[2] ..... E02F 3/00; E02F 3/32; B66F 9/22

[52] U.S. Cl. ..... 414/687; 37/103; 60/477; 212/8 R; 212/35 R; 414/694; 91/525

[58] Field of Search ..... 37/103, DIG. 7, DIG. 9, 37/117.5; 214/132, 138 R, 131 R, 130 R, 762–764; 91/411 R, 413; 212/3, 8 R, 30–34, 35 R, 35 H, 35 C, 58 R; 60/477

[56] References Cited

U.S. PATENT DOCUMENTS

| | | | |
|---|---|---|---|
| 3,481,251 | 12/1969 | Shook | 214/138 R X |
| 3,922,855 | 12/1975 | Bridwell et al. | 214/138 R |
| 3,960,284 | 6/1976 | Carpenter | 214/138 R |
| 3,978,998 | 9/1976 | Klitz | 214/138 R |
| 4,023,364 | 5/1977 | Bianchetta | 214/138 R |
| 4,030,623 | 6/1977 | Bridwell et al. | 214/138 R |
| 4,077,140 | 3/1978 | Branconi | 37/103 |
| 4,078,681 | 3/1978 | Field | 214/138 R |

*Primary Examiner*—E. H. Eickholt
*Attorney, Agent, or Firm*—Edwin E. Greigg

[57] ABSTRACT

A work vehicle having a work arm assembly mounted for horizontal oscillation on a swivel platform. The arm assembly and the swivel platform are actuated by separate hydraulic actuators. The two actuators are connected in parallel with one another to a control valve via a circuit selection valve. The arrangement enables the swivel platform and the arm assembly to move in the same direction by operating the control valve.

9 Claims, 3 Drawing Figures

WORK VEHICLE WITH HYDRAULIC CIRCUIT FOR SWIVEL MOTOR AND WORK ASSEMBLY ARM MOTOR

BACKGROUND OF THE INVENTION

This invention relates to a work vehicle having a swivel platform mounted on a chassis, and work arm assembly mounted for horizontal oscillation on the swivel platform, in which the swivel platform and the work arm assembly are actuated by means of separate hydraulic actuators.

Taking a swivel type backhoe carrying a bucket on a swivel platform as an example of this type of work vehicle, there are two alternative ways of moving the bucket in a horizontal direction between a spot of digging and a spot of depositing removed soil. One is by oscillating the arm assembly horizontally and the other by swivelling the swivel platform. Which method to choose is dependent on the space of the operation site and the like. When digging a ditch alongside a wall or such object by setting the swivel platform and the arm assembly oppositely turned, one of the above two methods is taken and hardly ever are they used simultaneously.

For operating the swivel platform and the arm assembly separately, the known arrangement provides a control valve on a flow passage leading to each of the hydraulic actuators, and two hand levers are selectively operated according to the desired mode of movement.

In short, the swivel platform and the arm assembly are alternatively moved to suit the site and nature of operation, and the hand lever for whichever is selected alone is operated.

The known arrangement as such requires two expensive control valves and has a disadvantage in the matter of safety insomuch that the wrong one of the valves could be operated or they could be switched in the wrong direction.

SUMMARY OF THE INVENTION

This invention has been made taking note of the fact that the swivel platform and the arm assembly are not moved simultaneously. It is an object of the invention to provide a work vehicle capable of safe arm movement in a desired manner by means of an organic association in horizontal oscillation between the swivel platform and the arm assembly, while aiming at simplicity of the hydraulic circuit.

With a view to realizing the above object, a work vehicle according to this invention has a swivel platform mounted on a chassis, a work arm assembly mounted for horizontal oscillation on the swivel platform, and a hydraulic circuit enabling the swivel platform and the work arm assembly to be actuated by means of separate hydraulic actuators, the hydraulic circuit comprising a control valve connected to the actuators in parallel, and a passage selection valve interposed between the control valve and the actuators, the swivel platform and the arm assembly being movable in the same direction as the control valve is operated in one direction.

Thus, the hydraulic circuit is made simple, taking advantage of the fact that the swivel platform and the work arm assembly are not driven simultaneously and their operating manners are the same, by using an inexpensive flow passage switch valve in the place of a very expensive control valve. Once the flow passage switch valve has been set, the swivel platform or the work arm assembly can be driven by operating the single control valve. They are driven in the same direction as the control valve is operated in one direction, and with the same sense of operation. This will eliminate errors in operation, hence assuring safety in using the work arm assembly.

The hydraulic circuit can be simplified by connecting a motor for the swivel platform and a dozer cylinder in parallel with one another to a control valve and providing a selection valve on flow passages leading to the motor for the swivel platform and the dozer cylinder to select between the swivel platform and a dozer implement. However, if an error should occur in switching operation, it could result in an extremely dangerous situation, since the swivel platform and the dozer implement have very different functions. For example, the swivel platform will swivel unexpectedly when vertical movement of the dozer is intended.

According to this invention, an organic association is made between items of the same functional nature, namely the work arm assembly and the swivel motor. In operating either of these items the operator is to direct his attention to his right and left. Therefore, safety is assured in the event of an error in operating the circuit selection valve. Thus this invention has realized a simple hydraulic circuit which assures safety.

Another object of this invention has relevance to a work vehicle that has two pumps for driving travel means on both sides of the vehicle, one pump for one travel means, wherein one of the pumps is adapted to drive the dozer implement as well. The invention provides means for preventing the vehicle from deviating sideways while travelling, which would otherwise occur owing to a difference in fluid supply to motors for the two travel means.

Still another object of this invention has relevance to oscillation of the work arm assembly which is conducted by fixing the arm assembly on the swivel platform and swivelling the latter. The invention provides means for minimizing a gradual diplacement of the cylinder acting to fix the position of the work arm assembly, which displacement is due to fluid leakage under the force of inertia caused by the swivelling.

Other objects and advantages of this invention will be apparent from the following description.

BRIEF DESCRIPTION OF THE DRAWINGS

In the drawings illustrating embodiments of this invention.

DESCRIPTION OF PREFERRED EMBODIMENTS

Figure 1:
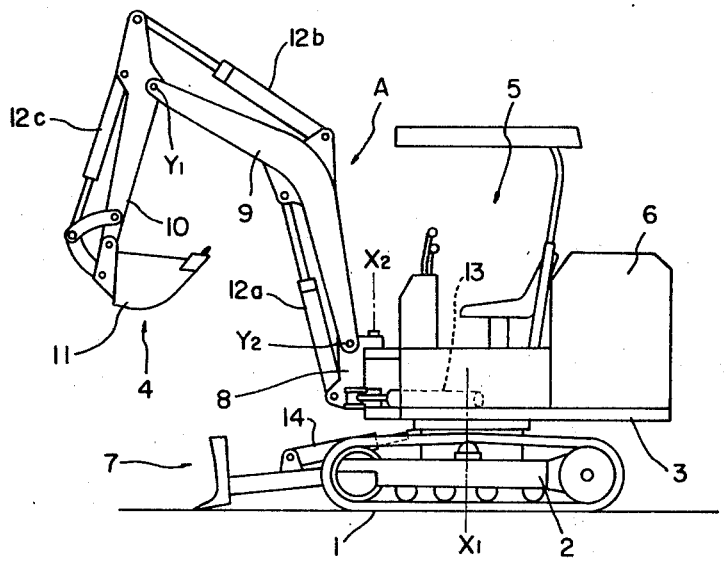
FIG. 1 is a side elevation of a work vehicle.

The invention is described in detail hereinafter with reference to the drawings showing a backhoe as an example of work vehicle.

The backhoe is shown having a chassis 2 provided with crawler travel means 1 and a swivel platform 3, a work arm assembly A mounted on swivel platform 3 oscillatably about a vertical axis $X_1$, an operation room 5, an engine 6, and a dozer implement 7 attached to chassis 2. Work arm assembly A is mounted on swivel platform 3 through an oscillatable bracket 8 oscillatably yet about a vertical axis $X_2$, and includes a boom 9 and an arm 10 interconnected for refraction at a horizontal axis $Y_1$, a hydraulic cylinder 12*a* to cause vertical oscillation of boom 9 about a horizontal axis $Y_2$ pivoted to bracket 8, hydraulic cylinder 13 to cause oscillation of boom 9 about a vertical axis $X_2$ of bracket 8, and a hydraulic cylinder 12*b* to actuate arm 10.

The embodiment of this invention has the above arrangement suitable for carrying a digging implement 4 to be described hereinafter. However, it should be noted that the arrangement could vary to allow a different implement to be carried.

Digging implement 4 includes a bucket 11 oscillatably attached to arm 10 of arm assembly A and a cylinder 12*c* to actuate bucket 11. Indicated at 14 in a dozer cylinder associated with dozer implement 7.

Figure 2:
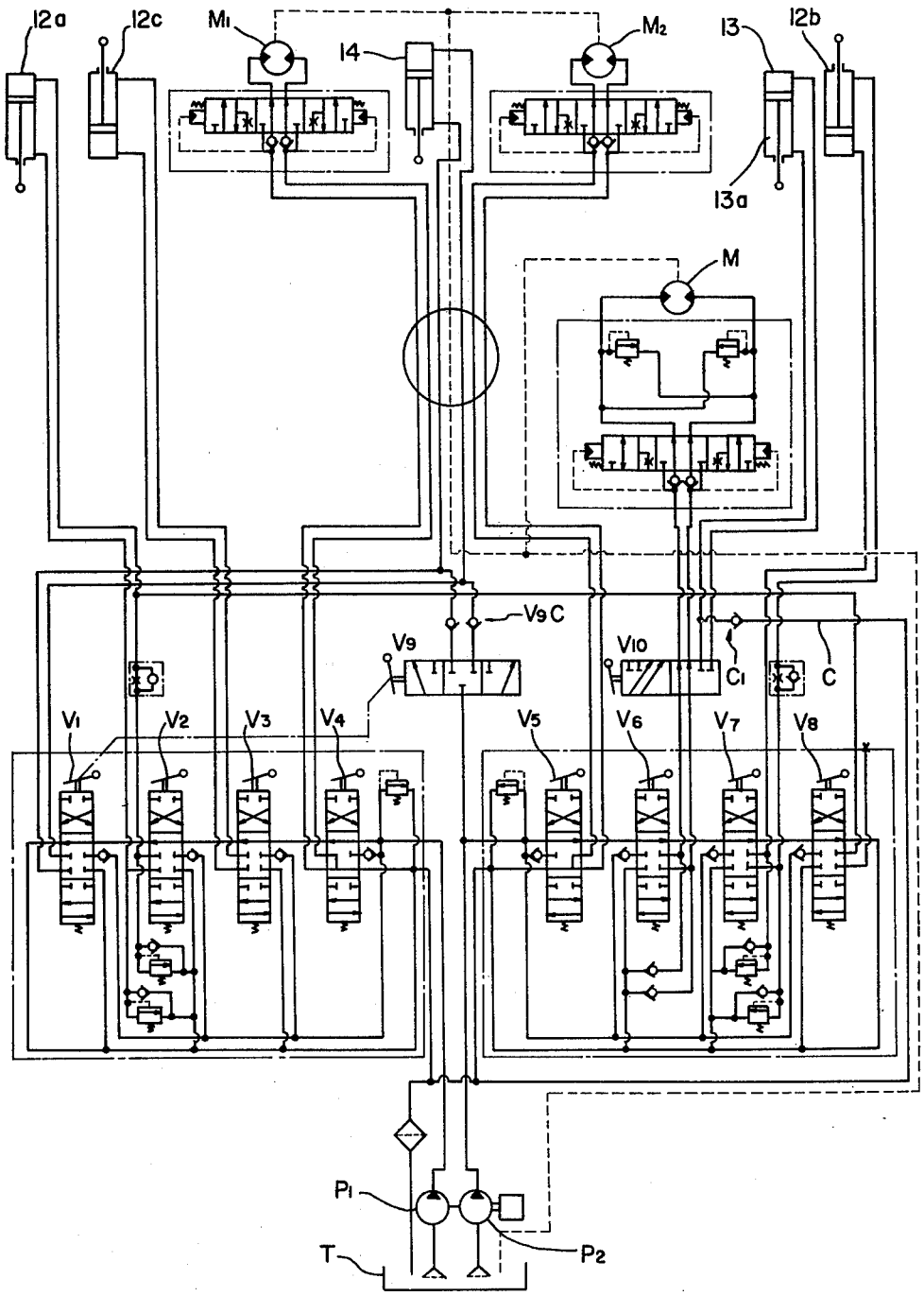
FIG. 2 is a schematic diagram of a hydraulic circuit.

Cylinders 12*a*, 12*b* and 13 of arm assembly A, cylinders 12*c* for bucket 11 of digging implement 4, hydraulic motor M for swivelling platform 3, hydraulic motors $M_1$, $M_2$ for driving travel means 1, 1' on both sides of the vehicle, and hydraulic cylinder 14 of dozer implement 7 are all controlled by a hydraulic circuit shown in FIG. 2.

The hydraulic circuit includes two pumps $P_1$, $P_2$ actuated by engine 6. To the first pumps $P_1$ are connected in parallel with one another control valves $V_1$–$V_4$ associated respectively with dozer cylinder 14, cylinders 12*a*, 12*c* for boom 9 and bucket 11 and one of the travel motors $M_1$. To the second pump $P_2$ are connected in parallel with one another control valves $V_5$–$V_8$ associated respectively with the other travel motor $M_2$, motor M for swivelling, cylinder 12*b* for arm 10, and cylinder 12*a* for boom 9. Fluids from valve $V_2$ and valve $V_8$ are supplied confluently to cylinder 12*a*. Further, a rotary type switch valve $V_9$ of simple construction is connected on one hand to second pump $P_2$ in parallel with control valves $V_5$–$V_8$, and on the other hand to dozer cylinder 14. Switch valve $V_9$ is operatively connected with control valve $V_1$ for dozer cylinder 14. This operative connection serves to prevent the vehicle from deviating sideways during bulldozing operation with digging implement 4 at rest; such deviation would otherwise occur owing to the fact that fluid supplied under pressure from first pump $P_1$ is shared by one travel motor $M_1$ and dozer cylinder 14 while fluid supplied from second pump $P_2$ is monopolized by the other travel motor $M_2$. In other words, the operative connection allows the two travel motors $M_1$, $M_2$ to receive an equal supply of fluid from pumps $P_1$, $P_2$. Switch valve $V_9$ is provided with a check valve $V_{9C}$ which permits fluid to flow only in the direction from pump $P_2$ to dozer cylinder 14.

Indicated at $V_{10}$ is a circuit selection valve interposed between control valve $V_6$ and swivel motor M. This valve $V_{10}$ is merely for opening and closing circuits, and is inexpensive compared with the described control valves. Valve $V_{10}$ is operated with a foot pedal. Cylinder 13 for causing oscillation of arm assembly A is connected to circuit selection valve $V_{10}$ in parallel with swivel motor M, wherefore fluid is supplied alternatively to cylinder 13 and to swivel motor M. The parallel connection is such that arm assembly A and swivel platform 3 move in the same direction as control valve $V_6$ is operated in one direction.

Figure 3:
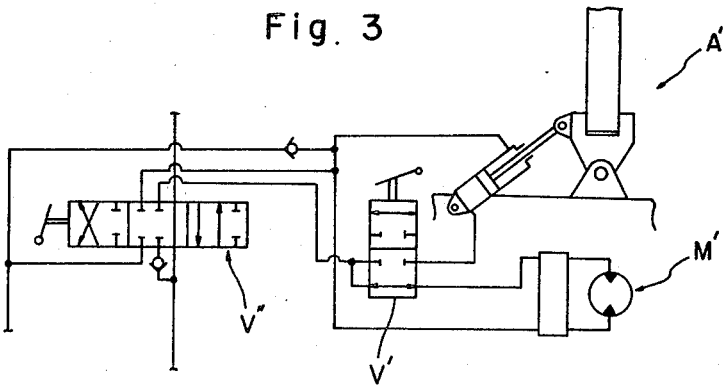
FIG. 3 is a schematic diagram in part of a hydraulic circuit in another embodiment.

As shown in FIG. 3, it is possible to connect a fluid passage for oscillating arm assembly A' to the right and a fluid passage for swivelling swivel platform M' to the right and to connect passages for oscillating or swivelling them to the left. One pair of the connected passages has a selection valve V' to select between the passages so that swivel platform M' and arm assembly A' are alternatively moved by operating a single valve V''.

Indicated at C is an auxiliary fluid passage adapted to supplement fluid to a rod chamber 13*a* of cylinder 13 for causing oscillation of arm assembly A. Auxiliary fluid passage C is connected at one end to a fluid passage linking rod chamber 13*a* and circuit selection valve $V_{10}$ and at the other end to a fluid tank T. Indicated at $C_1$ is a check valve provided on fluid passage C to permit flow in the direction of cylinder 13 only. This arrangement aims at solving the problem that arises when arm assembly A is fixed at a desired angle with swivel platform 3 by means of cylinder 13 so that oscillation of arm assembly A is effected by the swivelling of swivel platform 3. To be more particular, as the brake is applied to stop the oscillation of arm assembly A effected in the above manner for digging and soil removal operation, an external force will act on the cylinder 13 and the piston rod by reason of inertia and boost the inner pressure of the cylinder, which will result in fluid leakage in control valve $V_6$ and circuit selection valve $V_{10}$ connected to cylinder 13 and shift the relative position between the cylinder 13 and the piston. Repetition of the oscillation and the braking will inconveniently cause a great deviation from the predetermined fixing angle. It is conceivable to supplement fluid to the two chambers of cylinder 13 to compensate for the leakage, but this will result in a great leakage from rod chamber 13*a* than from the other chamber as the former will have the greater inner pressure by reason of the smaller piston area, and cause a gradual displacement of the piston towards rod chamber 13*a*.

In this invention, fluid is supplemented only to rod chamber 13*a* so that the degree of piston displacement is smaller than in the case of supplementing fluid to the two chambers. When rod chamber 13*a* is compressed negative pressure will occur in the opposite chamber which is closed, whereby the movement of the piston is weakened, and the leakage and the piston displacement are diminished.

A valve mechanism provided adjacent to each of the two travel motors $M_1$, $M_2$ and swivel motor M is a conventional one known as double counterbalance valve, and a description thereof is omitted as having no immediate reference to this invention.

The arrangement according to this invention may be worked in the following manner in accordance with the site and nature of operation. It is first determined how horizontal movement of bucket 11 should be effected, whether by the swivelling of swivel platform 3 or by the oscillation of work arm assembly A, on the basis of which circuit selection valve $V_{10}$ is switched. Then, swivel platform 3 or arm assembly A is actuated by manipulating one control valve $V_6$. Once circuit selection valve $V_{10}$ has been set in position, the movement of swivel platform 3 or arm assembly A and manipulation of a hand lever for operating control valve $V_6$ can be conducted with the same sense. That is, swivel platform 3 and arm assembly A are moved in the direction as control valve $V_6$ is operated in one direction.

We claim:

1. A work vehicle having a swivel platform (3) mounted on a chassis (2), a work arm assembly (A) mounted for horizontal oscillation on the swivel platform (3), and a hydraulic circuit enabling the swivel platform (3) and the work arm assembly (A) to be actuated by means of separate hydraulic actuators (M), (13) said hydraulic circuit comprising;

a control valve ($V_6$) connected to said actuators (M), (13) in parallel, and a passage selection valve ($V_{10}$) interposed between said control valve ($V_6$) and said actuators (M), (13), the swivel platform (3) and the arm assembly (A) being movable in the same direction as the control valve ($V_6$) is operated in one direction.

2. A work vehicle as defined in claim 1 further comprising;

travel means (1), (1') provided on both sides of the vehicle, hydraulic travel motors ($M_1$), ($M_2$) to drive said travel means (1), (1'), respectively, and two pumps ($P_1$), ($P_2$) to supply fluid to said motors ($M_1$), ($M_2$) separately.

3. A work vehicle as defined in claim 2 further comprising;

a dozer implement (7) driven by fluid supplied from said pump ($P_1$), a dozer cylinder (14) to drive said dozer implement (7), and a control valve ($V_1$) provided on a circuit between said pump ($P_1$) and said dozer cylinder (14).

4. A work vehicle as defined in claim 3 further comprising;

a switch valve ($V_9$) connected to the other pump ($P_2$) to supply fluid to a circuit between said valve ($V_1$) and said dozer cylinder (14) to produce confluence, and a check valve ($V_{9C}$) interposed between said switch valve ($V_9$) and said dozer cylinder (14), said check valve ($V_{9C}$) being adapted to prevent fluid flow from said dozer cylinder (14) to said switch valve ($V_9$).

5. A work vehicle as defined in claim 4 wherein said switch valve ($V_9$) is a rotary type valve.

6. A work vehicle as defined in claim 5 wherein said control valve ($V_1$) and said switch valve ($V_9$) are operatively connected.

7. A work vehicle as defined in claim 2 further comprising a bucket driven by fluid supplied from said pump ($P_1$), said actuator (13) for driving said work arm assembly (A) is a cylinder type actuator.

8. A work vehicle as defined in claim 7 further comprising means for supplementing fluid to a circuit leading to a rod chamber (13*a*) of said cylinder type actuator (13).

9. A work vehicle as defined in claim 8 wherein said supplementing means comprises a fluid passage (C) connected to a tank (T) and a check valve ($C_1$) provided on said fluid passage (C), said check valve ($C_1$) is adapted to permit fluid to flow only to said rod chamber (13*a*) of said actuator (13) for said work arm assembly (A).

* * * * *